United States Patent [19]

Magid et al.

[11] Patent Number: 4,988,455

[45] Date of Patent: Jan. 29, 1991

[54] AZEOTROPE-LIKE COMPOSITIONS OF 1,1-DICHLORO-1,2,2-TRIFLUOROPROPANE AND ALKANOL HAVING 1 TO 4 CARBON ATOMS

[75] Inventors: Hillel Magid, Buffalo; Richard E. Eibeck, Orchard Park; Michael Van Der Puy, Cheektowaga; Richard M. Hollister, Buffalo; Dennis M. Lavery, Springville, all of N.Y.

[73] Assignee: Allied-Signal Inc., Morris Township, Morris County, N.J.

[21] Appl. No.: 417,985

[22] Filed: Oct. 6, 1989

[51] Int. Cl.[5] ..... C11D 7/30; C11D 7/50

[52] U.S. Cl. ..... 252/171; 252/162; 252/170; 252/364; 252/DIG. 9; 134/12; 134/40

[58] Field of Search ..... 252/162, 170, 171, 364, 252/DIG. 9; 134/38, 39, 40, 12

[56] References Cited

U.S. PATENT DOCUMENTS 2,838,457 6/1958 Ballentine ..... 252/78

FOREIGN PATENT DOCUMENTS 347924 12/1989 European Pat. Off. .
1562026 3/1980 United Kingdom .
8912674 12/1989 World Int. Prop. O. .

OTHER PUBLICATIONS

*Asahi Glass Company News*, Feb. 6, 1989 (News Release).

Patent Application Ser. No. 315,069, filed 2/24/89.

*Primary Examiner*—Paul Lieberman
*Assistant Examiner*—Linda D. Skaling
*Attorney, Agent, or Firm*—Melanie L. Brown; Jay P. Friedenson

[57] ABSTRACT

Azeotrope-like compositions consisting essentially of 1,1-dichloro-1,2,2-trifluoropropane and alkanol having 1 to 4 carbon atoms are stable and have utility as degreasing agents and as solvents in a variety of industrial cleaning applications including cold cleaning and defluxing of printed circuit boards.

28 Claims, No Drawings

AZEOTROPE-LIKE COMPOSITIONS OF 1,1-DICHLORO-1,2,2-TRIFLUOROPROPANE AND ALKANOL HAVING 1 TO 4 CARBON ATOMS

FIELD OF THE INVENTION

This invention relates to azeotrope-like or essentially constant-boiling mixtures of 1,1-dichloro-1,2,2-trifluoropropane and alkanol having 1 to 4 carbon atoms. These mixtures are useful in a variety of vapor degreasing cold cleaning and solvent cleaning applications including defluxing.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form vapor degreasing or solvent cleaning consists of exposing a room temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Cold cleaning is another application where a number of solvents are used. In most cold cleaning applications, the soiled part is either immersed in the fluid or wiped with rags or similar objects soaked in solvents and allowed to air dry.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they do not fractionate upon boiling. This behavior is desirable because in the previously described vapor degreasing equipment with which these solvents are employed, redistilled material is generated for final rinse-cleaning. Thus, the vapor degreasing system acts as a still. Unless the solvent composition exhibits a constant boiling point i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not an azeotrope or azeotrope-like would result in mixtures with changed compositions which may have less desirable properties, such as lower solvency towards soils, less inertness towards metal, plastic or elastomer components, and increased flammability and toxicity.

The art is continually seeking new fluorocarbon based azeotropic mixtures or azeotrope-like mixtures which offer alternatives for new and special applications for vapor degreasing and other cleaning applications. Currently, of particular interest are such azeotrope-like mixtures which are based on fluorocarbons which are considered to be stratospherically safe substitutes for presently used fully halogenated chlorofluorocarbons. The latter are suspected of causing environmental problems in connection with the earth's protective ozone layer. Mathematical models have substantiated that hydrochlorofluorocarbons, such as 1,1-dichloro-1,2,2-trifluoropropane (HCFC-243cc), will not adversely affect atmospheric chemistry, being negligible contributors to ozone depletion and to greenhouse global warming in comparison to the fully halogenated species.

In our search for new fluorocarbon based azeotropic or azeotrope-like mixtures, we unexpectedly discovered 1,1-dichloro-1,2,2-trifluoropropane based azeotropes.

It is an object of this invention to provide novel azeotrope-like compositions based on HCFC-243cc and alkanol having 1 to 4 carbon atoms which are liquid at room temperature, which will not fractionate under the process of distillation or evaporation and which are useful as solvents for use in vapor degreasing and other solvent cleaning applications including defluxing applications.

Another object of the invention is to provide noVel environmentally acceptable solvents for use in the aforementioned applications.

Other objects and advantages of the invention will become apparent from the following description.

DESCRIPTION OF THE INVENTION

In accordance with the invention, novel azeotrope-like compositions have been discovered comprising 1,1-dichloro-1,2,2-trifluoropropane and alkanol having 1 to 4 carbon atoms. The alkanol is an alkanol selected from the group consisting of methanol, ethanol, 1-propanol, 2-propanol, and 2-methyl-2-propanol.

The novel azeotrope-like compositions comprise from about 82 to about 98.5 weight percent 1,1-dichloro-1,2,2-trifluoropropane and from about 1.5 to about 18 weight percent alkanol having 1 to 4 carbon atoms.

In one embodiment, novel azeotrope-like compositions comprise 1,1-dichloro-1,2,2-trifluoropropane and methanol which boil at about 49.0° C.±about 0.6 at 760 mm Hg (101 kPa).

More specifically, novel azeotrope-like compositions of the invention comprise from about 82 to about 95 weight percent 1,1-dichloro-1,2,2-trifluoropropane and from about 5 to about 18 weight percent methanol which boil at about 49.0° C. at 760 mm Hg (101 kPa).

In a preferred embodiment of the invention, the azeotrope-like compositions of the invention comprise from about 83 to about 94 weight percent 1,1-dichloro-1,2,2-trifluoropropane and from about 6 to about 17 weight percent methanol.

In a still more preferred embodiment of the invention, the azeotrope-like compositions of the invention comprise from about 84 to about 94 weight percent 1,1-dichloro-1,2,2-trifluoropropane and from about 6 to about 16 weight percent methanol.

In a most preferred embodiment of the invention, the azeotrope-like compositions of the invention comprise from about 85 to about 94 weight percent 1,1-dichloro-1,2,2-trifluoropropane and from about 6 to about 15 weight percent methanol.

In another embodiment novel azeotrope-like compositions comprise 1,1-dichloro-1,2,2-trifluoropropane and ethanol which boil at about 55 0° C.±about 0.6° C. at 730 mm Hg (97 kPa).

More specifically novel azeotrope-like compositions of the invention comprise from about 83 to about 96 weight percent 1,1-dichloro-1,2,2-trifluoropropane and from about 4 to about 17 weight percent ethanol which boil at about 55.0° C. at 730 mm Hg (97 kPa).

In a preferred embodiment of the invention, the azeotrope-like compositions of the invention comprise from about 85 to about 95 weight percent 1,1-dichloro-1,2,2-trifluoropropane and from about 5 to about 15 weight percent ethanol.

In a still more preferred embodiment of the invention, the azeotrope-like compositions of the invention comprise from about 86 to about 95 weight percent 1,1-dichloro-1,2,2-trifluoropropane and from about 5 to about 14 weight percent ethanol.

In a most preferred embodiment of the invention, the azeotrope-like compositions of the invention comprise from about 87 to about 95 weight percent 1,1-dichloro-1,2,2-trifluoropropane and from about 5 to about 13 weight percent ethanol.

In another embodiment, novel azeotrope-like compositions comprise 1,1-dichloro-1,2,2-trifluoropropane and 1-propanol which boil at about 59.3° C.±about 0.4° C. at 746 mm Hg (99 kPa).

More specifically novel azeotrope-like compositions of the invention comprise from about 91 to about 98.5 weight percent 1,1-dichloro-1,2,2-trifluoropropane and from about 1.5 to about 9 weight percent 1-propanol which boil at about 59.3° C. at 746 mm Hg (99 kPa).

In a preferred embodiment of the invention the azeotrope-like compositions of the invention comprise from about 92 to about 98 weight percent 1,1-dichloro-1,2,2-trifluoropropane and from about 2 to about 8 weight percent 1-propanol.

In a most preferred embodiment of the invention, the azeotrope-like compositions of the invention comprise from about 93 to about 98 weight percent 1,1-dichloro-1,2,2-trifluoropropane and from about 2 to about 7 weight percent 1-propanol.

In another embodiment, novel azeotrope-like compositions comprise 1,1-dichloro-1,2,2-trifluoropropane and 2-propanol which boil at about 57.3° C.±about 0.4° C. at 750 mm Hg (100 kPa).

More specifically novel azeotrope-like compositions of the invention comprise from about 88 to about 97 weight percent 1,1-dichloro-1,2,2-trifluoropropane and from about 3 to about 12 weight percent 2-propanol which boil at about 57.3° C. at 750 mm Hg (100 kPa).

In a preferred embodiment of the invention, the azeotrope-like compositions of the invention comprise from about 90 to about 97 weight percent 1,1-dichloro-1,2,2-trifluoropropane and from about 3 to about 10 weight percent 2-propanol.

In a still more preferred embodiment of the invention, the azeotrope-like compositions of the invention comprise from about 91 to about 97 weight percent 1,1-dichloro-1,2,2-trifluoropropane and from about 3 to about 9 weight percent 2-propanol.

In a most preferred embodiment of the invention, the azeotrope-like compositions of the invention comprise from about 92 to about 97 weight percent 1,1-dichloro-1,2,2-trifluoropropane and from about 3 to about 8 weight percent 2-propanol.

In another embodiment, novel azeotrope-like compositions comprise 1,1-dichloro-1,2,2-trifluoropropane and 2-methyl-2-propanol which boil at about 59.4° C.±about 0.4° C. at 755 mm Hg (100kPa).

More specifically, novel azeotrope-like compositions of the invention comprise from about 85 to about 97 weight percent 1,1-dichloro-1,2,2-trifluoropropane and from about 3 to about 15 weight percent 2-methyl-2-propanol which boil at about 59.4° C. at 755 mm Hg (100 kPa).

In a preferred embodiment of the invention, the azeotrope-like compositions of the invention comprise from about 86 to about 96 weight percent 1,1-dichloro-1,2,2-trifluoropropane and from about 4 to about 14 weight percent 2-methyl-2-propanol.

In a most preferred embodiment of the invention, the azeotrope-like compositions of the invention comprise from about 87 to about 96 weight percent 1,1-dichloro-1,2,2-trifluoropropane and from about 4 to about 13 weight percent 2-methyl-2-propanol.

The precise or true azeotrope compositions have not been determined but have been ascertained to be within the indicated ranges. Regardless of where the true azeotropes lie, all compositions within the indicated ranges, as well as certain compositions outside the indicated ranges, are azeotrope-like, as defined more particularly below.

From fundamental principles, the thermodynamic state of a fluid is defined by four variables: pressure, temperature, liquid composition and vapor composition, or P-T-X-Y, respectively. An azeotrope is a unique characteristic of a system of two or more components where X and Y are equal at the stated P and T. In practice, this means that the components of a mixture cannot be separated during distillation, and therefore are useful in vapor phase solvent cleaning as described above.

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, one way to determine whether a candidate mixture is "azeotrope-like" within the meaning of this invention, is to distill a sample thereof under conditions (i.e. resolution—number of plates) which would be expected to separate the mixture into its separate components. If the mixture is non-azeotropic or non-azeotrope-like, the mixture will fractionate, i.e. separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly as does the boiling point of the composition. Thus, an azeotrope of A and B represents a unique type of relationship but with a variable composition depending on temperature and/or pressure. With HCFC-243cc and methanol, the preferred mixtures boil within about±0.6° C (at about 760 mm Hg (101 kPa)) of the 49.0° C. boiling point. With HCFC-243cc and ethanol, the preferred mixtures boil within about±0.6° C. (at about 730 mm Hg (97 kPa)) of the 55 0° C. boiling point. With HCFC-243cc and 1-propanol, the preferred mixtures boil within about±0.4° C. (at about 746 mm Hg (99 kPa)) of the 59.3° C. boiling point. With HCFC-243cc and 2-propanol, the preferred mixtures boil within about±0.4° C. (at about 750 mm Hg (100 kPa)) of the 57.3° C. boiling point. With HCFC-243cc and 2-methyl-2-propanol, the preferred mixtures boil within about±0.4° C. (at about 755 mm Hg (100 kPa)) of the 59.4° C. boiling point. As is readily understood by persons skilled in the art the boiling point of the azeotrope will vary with the pressure.

In the process embodiment of the invention, the azeotrope-like compositions of the invention may be used to clean solid surfaces by treating said surfaces with said compositions in any manner well known to the art such as by dipping or spraying or use of conventional degreasing apparatus.

It should be noted that HCFC-243cc is useful as a solvent. The present azeotrope-like compositions are useful as solvents for use in vapor degreasing and other solvent cleaning applications including defluxing, cold cleaning, dry cleaning, dewatering, decontamination, spot cleaning, aerosol propelled rework, extraction, particle removal, and surfactant cleaning applications. These azeotrope-like compositions are also useful as Rankine cycle and absorption refrigerants and power fluids.

The HCFC-243cc, methanol, ethanol, 1-propanol, 2-propanol, and 2-methyl-2-propanol components of the novel solvent azeotrope-like compositions of the invention are known materials. Commercially available methanol, ethanol 1-propanol, 2-propanol, and 2-methyl-2-propanol may be used in the present invention. Until HCFC-243cc becomes available in commercial quantities HCFC-243cc may be prepared by a standard and well-known organic synthesis technique. For example, to prepare 1,1-dichloro-1,2,2-trifluoropropane, antimony trifluoride, bromine, and 2,2-dichloropropane are reacted together to form 2,2-difluoropropane. Then, chlorine and the 2,2-difluoropropane are reacted to form 1,1,1-trichloro-2,2-difluoropropane. Finally, antimony trifluoride, chlorine, and the 1,1,1-trichloro-2,2-difluoropropane are reacted to form 1,1-dichloro-1,2,2-trifluoropropane. A detailed synthesis is set forth below.

Preferably, the materials should be used in sufficiently high purity so as to avoid the introduction of adverse influences upon the solvency properties or constant-boiling properties of the system.

It should be understood that the present compositions may include additional components so as to form new azeotrope-like compositions. Any such compositions are considered to be within the scope of the present invention as long as the compositions are constant-boiling or essentially constant-boiling and contain all of the essential components described herein.

The present invention is more fully illustrated by the following non-limiting Examples.

EXAMPLE 1

This example is directed to the preparation of 1,1-dichloro-1,2,2-trifluoropropane.

Part A—Synthesis of 2,2-difluoropropane. Antimony trifluoride(1 kg, 5.6 mol), which had been dried at 160° C. for 4 hours under vacuum, was charged to a 2-liter, 3-necked flask fitted with a thermometer and water condenser. The condenser was attached to two cold traps, one at 0° C. and one at −78° C. Bromine(50g) was then added and the mixture allowed to stand for 1 hour. 2,2-dichloropropane(487 g. 4.3 mol) was then added dropwise over 1.5 hours during which time, the temperature rose to 45° C. When the addition was completed the mixture was heated without stirring to 70° C. over 3 hours. The product from the cold traps(258 g) was distilled to give 186 g(53% yield) of 2,2-difluoropropane.

Part B—Synthesis of 1,1,1-trichloro-2,2-difluoropropane. 2,2-difluoropropane(produced in Part A above), (10.75 g, 0.134 mol) and 30.2 g chlorine(0.43 mol) were charged to a 22-liter flask and irradiated with a 275 W sunlamp at a distance of 5 inches(12.7 cm) for 90 minutes. The product mixture was dissolved in methylene chloride and drawn out of the flask by syringe. The process was repeated until 272 g crude product had been collected. It was then washed with bicarbonate solution, dried with magnesium sulfate, and distilled to afford 175 g of 1,1,1-trichloro-2,2-difluoropropane.

Part C—Synthesis of 1,1-dichloro-1,2,2-trifluoropropane.

Dry antimony trifluoride(164 g, 0.92 mol) in a 1-liter, 3-necked flask was treated with chlorine(9.2 g, 0.13 mol) at 65° C., followed by the addition of 29 ml antimony trichloride(67 g, 0.22 mol) at room temperature. After stirring for 0.5 hour, the mixture was warmed to 65° C. A condenser attached to the flask was warmed to 55° C. by means of a circulating bath, and the condenser attached to a −78° C. cold trap. 1,1,1-trichloro-2,2-difluoropropane(produced in part B above), (133 g, 0.727 mol) was then introduced into the flask which was then heated to 125° C. over a period of 3.5 hours. The contents of the cold trap were washed with bicarbonate solution and distilled to give 4.3 g(45% yield) 1,1-dichloro-1,2,2-trifluoropropane, b.p. 56–60° C.(60° C. in E. T. McBee et al., *J. Am. Chem. Soc.* 62, 3340(1940)). $^1H$ NMR: Delta 1.9(dt); $^{19}F$ NMR: 73(t) and 103 (dq) ppm upfield from $CFCl_3$.

EXAMPLE 2

This example shows that a minimum in the boiling point versus composition curve occurs ranging from 85 to 94 weight percent HCFC-243cc and 6 to 15 weight percent methanol, indicating that an azeotrope forms in the neighborhood of this composition.

The temperature of the boiling liquid mixtures was measured using ebulliometry. An ebulliometer charged with measured quantities of HCFC-243cc was used in the present example.

The ebulliometer consisted of a heated sump in which the HCFC-243cc was brought to boil. The upper part of the ebulliometer connected to the sump was cooled thereby acting as a condenser for the boiling vapors, allowing the system to operate at total reflux. After bringing the HCFC-243cc to boil at atmospheric pressure, measured amounts of methanol were titrated into the ebulliometer. The change in boiling point was measured with a platinum resistance thermometer.

The following Table I shows the boiling point measurements at atmospheric pressure for various mixtures of HCFC-243cc and methanol.

TABLE I

| LIQUID MIXTURE | | |
|---|---|---|
| Weight Percentage HCFC-243 cc | Weight Percentage Methanol | Boiling Point (°C.) @ 759.5 mmHg (101 kPa) |
| 100.00 | 0.00 | 60.321 |
| 99.71 | 0.29 | 59.353 |
| 98.59 | 1.41 | 54.701 |
| 96.41 | 3.59 | 49.814 |
| 93.82 | 6.18 | 49.145 |
| 91.36 | 8.64 | 49.020 |
| 89.03 | 10.97 | 48.987 |
| 86.92 | 13.18 | 48.986 |
| 82.70 | 17.30 | 49.010 |
| 80.79 | 19.21 | 49.023 |
| 78.96 | 21.04 | 49.047 |
| 77.22 | 22.78 | 49.063 |
| 75.54 | 24.46 | 49.085 |
| 73.94 | 26.06 | 49.107 |
| 72.41 | 27.59 | 49.145 |
| 70.94 | 29.06 | 49.176 |
| 69.53 | 30.47 | 49.252 |

EXAMPLE 3

Example 2 was repeated for Example 3 except that ethanol was used. This example shows that a minimum in the boiling point versus composition curve occurs ranging from 87 to 95 weight percent HCFC-243cc and 5 to 13 weight percent ethanol, indicating that an azeotrope forms in the neighborhood of this composition.

The following Table II shows the boiling points measurements at atmospheric pressure for various mixtures of HCFC-243cc and ethanol.

TABLE II

| LIQUID MIXTURE | | |
|---|---|---|
| Weight Percentage HCFC-243 cc | Weight Percentage Ethanol | Boiling Point (°C.) @ 729.6 mmHg (97 kPa) |
| 100.00 | 0.00 | 59.954 |
| 99.72 | 0.28 | 59.127 |
| 98.60 | 1.40 | 56.847 |
| 97.51 | 2.49 | 55.688 |
| 96.44 | 3.56 | 55.280 |
| 95.39 | 4.61 | 55.135 |
| 94.37 | 5.63 | 55.076 |
| 93.36 | 6.64 | 55.041 |
| 92.38 | 7.62 | 55.029 |
| 91.42 | 8.58 | 55.022 |
| 90.48 | 9.52 | 55.033 |
| 89.56 | 10.44 | 55.046 |
| 88.66 | 11.34 | 55.058 |
| 87.77 | 12.23 | 55.082 |
| 86.91 | 13.09 | 55.105 |
| 86.06 | 13.94 | 55.128 |
| 85.22 | 14.78 | 55.142 |
| 84.40 | 15.60 | 55.145 |
| 83.60 | 16.40 | 55.155 |
| 82.04 | 17.96 | 55.163 |

EXAMPLE 4

Example 2 was repeated for Example 4 except that 1-propanol was used. This example shows that a minimum in the boiling point versus composition curve occurs ranging from 93 to 98 weight percent HCFC-243cc and 2 to 7 weight percent 1-propanol, indicating that an azeotrope forms in the neighborhood of this composition.

The following Table III shows the boiling points measurements at atmospheric pressure for various mixtures of HCFC-243cc and 1-propanol.

TABLE III

| LIQUID MIXTURE | | |
|---|---|---|
| Weight Percentage HCFC-243 cc | Weight Percentage 1-Propanol | Boiling Point (°C.) @ 745.8 mmHg (99 kPa) |
| 100.00 | 0.00 | 60.13 |
| 99.71 | 0.29 | 59.93 |
| 99.42 | 0.58 | 59.77 |
| 99.13 | 0.87 | 59.63 |
| 98.56 | 1.44 | 59.45 |
| 98.00 | 2.00 | 59.38 |
| 97.45 | 2.55 | 59.34 |
| 96.90 | 3.10 | 59.33 |
| 96.35 | 3.65 | 59.33 |
| 95.82 | 4.18 | 59.31 |
| 95.28 | 4.72 | 59.33 |
| 94.76 | 5.24 | 59.35 |
| 94.24 | 5.76 | 59.36 |
| 93.72 | 6.28 | 59.38 |
| 93.21 | 6.79 | 59.42 |
| 92.71 | 7.29 | 59.42 |
| 92.21 | 7.79 | 59.43 |
| 91.72 | 8.28 | 59.45 |
| 90.75 | 9.25 | 59.46 |
| 89.80 | 10.20 | 59.48 |
| 88.87 | 11.13 | 59.50 |
| 87.96 | 12.04 | 59.52 |
| 87.67 | 12.93 | 59.54 |
| 85.34 | 14.66 | 59.57 |
| 83.68 | 16.32 | 59.61 |
| 82.08 | 17.92 | 59.61 |

EXAMPLE 5

Example 2 was repeated for Example 5 except that 2-propanol was used. This example shows that a minimum in the boiling point versus composition curve occurs ranging from 92 to 97 weight percent HCFC-243cc and 3 to 8 weight percent 2-propanol, indicating that an azeotrope forms in the neighborhood of this composition.

The following Table IV shows the boiling points measurements at atmospheric pressure for various mixtures of HCFC-243cc and 2-propanol.

TABLE IV

| LIQUID MIXTURE | | |
|---|---|---|
| Weight Percentage HCFC-243 cc | Weight Percentage 2-Propanol | Boiling Point (°C.) @ 750.2 mmHg (100 kPa) |
| 100.00 | 0.00 | 60.056 |
| 99.72 | 0.28 | 59.736 |
| 99.44 | 0.56 | 59.517 |
| 99.16 | 0.84 | 59.360 |
| 98.06 | 1.94 | 58.230 |
| 96.98 | 3.02 | 57.619 |
| 95.93 | 4.07 | 57.374 |
| 94.90 | 5.10 | 57.339 |
| 93.89 | 6.11 | 57.458 |
| 92.91 | 7.09 | 57.486 |
| 91.34 | 8.66 | 57.493 |
| 90.99 | 9.01 | 57.514 |
| 90.07 | 9.93 | 57.543 |
| 89.16 | 10.84 | 57.554 |
| 87.39 | 12.61 | 57.679 |
| 86.54 | 13.46 | 57.692 |
| 85.70 | 14.30 | 57.738 |
| 84.88 | 15.12 | 57.785 |
| 83.28 | 16.72 | 57.877 |
| 81.74 | 18.26 | 57.920 |

EXAMPLE 6

Example 2 was repeated for Example 6 except that 2-methyl-2propanol was used. This example shows that a minimum in the boiling point versus composition curve occurs ranging from 87 to 96 weight percent HCFC-243cc and 4 to 13 weight percent 2-methyl-2-propanol, indicating that an azeotrope forms in the neighborhood of this composition.

The following Table V shows the boiling points measurements at atmospheric pressure for various mixtures of HCFC-243cc and 2-methyl-2-propanol.

TABLE V

| LIQUID MIXTURE | | |
|---|---|---|
| Weight Percentage HCFC-243 cc | Weight Percentage 2-Methyl-2-propanol | Boiling Point (°C.) @ 754.8 mmHg (100 kPa) |
| 100.00 | 0.00 | 60.46 |
| 99.43 | 0.57 | 60.45 |
| 98.87 | 1.13 | 60.22 |
| 98.32 | 1.68 | 60.02 |
| 97.77 | 2.23 | 59.82 |
| 97.23 | 2.77 | 59.70 |
| 96.69 | 3.31 | 59.60 |
| 96.16 | 3.84 | 59.51 |
| 95.63 | 4.37 | 59.42 |
| 95.11 | 4.89 | 59.40 |
| 94.60 | 5.40 | 59.40 |
| 94.09 | 5.91 | 59.38 |
| 93.59 | 6.41 | 59.40 |
| 93.09 | 6.91 | 59.39 |
| 92.60 | 7.40 | 59.41 |
| 92.11 | 7.89 | 59.43 |
| 91.63 | 8.37 | 59.43 |
| 91.16 | 8.84 | 59.43 |
| 90.68 | 9.32 | 59.43 |
| 90.22 | 9.78 | 59.43 |
| 89.75 | 10.25 | 59.44 |
| 89.30 | 10.70 | 59.44 |
| 88.84 | 11.16 | 59.43 |
| 88.40 | 11.60 | 59.42 |
| 87.95 | 12.05 | 59.42 |

TABLE V-continued

| LIQUID MIXTURE | | |
|---|---|---|
| Weight Percentage HCFC-243 cc | Weight Percentage 2-Methyl-2-propanol | Boiling Point (°C.) @ 754.8 mmHg (100 kPa) |
| 87.51 | 12.49 | 59.44 |
| 87.08 | 12.92 | 59.47 |
| 86.65 | 13.35 | 59.50 |
| 85.80 | 14.20 | 59.56 |
| 84.97 | 15.03 | 59.57 |
| 84.15 | 15.85 | 59.62 |
| 84.35 | 16.65 | 59.63 |
| 81.79 | 18.21 | 59.65 |
| 80.29 | 19.71 | 59.70 |

Inhibitors may be added to the present azeotrope-like compositions to inhibit decomposition of the compositions; react with undesirable decomposition products of the compositions; and/or prevent corrosion of metal surfaces. Any or all of the following classes of inhibitors may be employed in the invention: epoxy compounds such as propylene oxide; nitroalkanes such as nitromethane; ethers such as 1-4-dioxane; unsaturated compounds such as 1,4-butyne diol; acetals or ketals such as dipropoxy methane; ketones such as methyl ethyl ketone; alcohols such as tertiary amyl alcohol; esters such as triphenyl phosphite: and amines such as triethyl amine. Other suitable inhibitors will readily occur to those skilled in the art.

Having described the invention in detail and by reference to preferred embodiments thereof, it will be apparent that modifications and variations are possible without departing from the scope of the invention defined in the appended claims.

What is claimed is:

1. Azeotrope-like compositions consisting essentially of from about 82 to about 95 weight percent 1,1-dichloro-1,2,2-trifluoropropane and from about 5 to about 18 weight percent methanol which boil at about 49.0° C. at 760 mm Hg.

2. The azeotrope-like compositions of claim 1 consisting essentially of from about 83 to about 94 weight percent said 1,1-dichloro-1,2,2-trifluoropropane and from about 6 to about 17 weight percent said methanol.

3. The azeotrope-like compositions of claim 1 consisting essentially of from about 84 to about 94 weight percent said 1,1'-dichloro-1,2,2-trifluoropropane and from about 6 to about 16 weight percent said methanol.

4. The azeotrope-like compositions of claim 1 consisting essentially of from about 85 to about 94 weight percent said 1,1-dichloro-1,2,2-trifluoropropane and from about 6 to about 15 weight percent said methanol.

5. The azeotrope-like compositions of claim 1 wherein said compositions additionally contain an inhibitor in an amount effective to inhibit decomposition of said compositions, react with undesirable decomposition products of said compositions, or prevent corrosion of metal surfaces.

6. Azeotrope-like compositions consisting essentially of from about 83 to about 96 weight percent 1,1-dichloro-1,2,2-trifluoropropane and from about 4 to about 17 weight percent ethanol which boil at about 55.0° C. at 730 mm Hg.

7. The azeotrope-like compositions of claim 6 consisting essentially of from about 85 to about 95 weight percent said 1,1-dichloro-1,2,2 trifluoropropane and from about 5 to about 15 weight percent said ethanol.

8. The azeotrope-like compositions of claim 6 consisting essentially of from about 86 to about 95 weight percent said 1,1-dichloro-1,2,2-trifluoropropane and from about 5 to about 14 weight percent said ethanol.

9. The azeotrope-like compositions of claim 6 consisting essentially of from about 87 to about 95 weight percent said 1,1-dichloro-1,2,2-trifluoropropane and from about 5 to about 13 weight percent said ethanol.

10. The azeotrope-like compositions of claim 6 wherein said compositions additionally contain an inhibitor in an amount effective to inhibit decomposition of said compositions, react with undesirable decomposition products of said compositions, or prevent corrosion of metal surfaces.

11. Azeotrope-like compositions consisting essentially of from about 91 to about 98.5 weight percent 1,1-dichloro-1,2,2-trifluoropropane and from about 1.5 to about 9 weight percent 1-propanol which boil at about 59.3° C. at 746 mm Hg.

12. The azeotrope-like compositions of claim 11 consisting essentially of from about 92 to about 98 weight percent said 1,1-dichloro-1,2,2-trifluoropropane and from about 2 to about 8 weight percent said 1-propanol.

13. The azeotrope-like compositions of claim 11 consisting essentially of from about 93 to about 98 weight percent said 1,1-dichloro-1,2,2-trifluoropropane and from about 2 to about 7 weight percent said 1-propanol.

14. The azeotrope-like compositions of claim 11 wherein said compositions additionally contain an inhibitor in an amount effective to inhibit decomposition of said compositions, react with undesirable decomposition products of said compositions, or prevent corrosion of metal surfaces.

15. Azeotrope-like compositions consisting essentially of from about 88 to about 97 weight percent 1,1-dichloro-1,2,2-trifluoropropane and from about 3 to about 12 weight percent 2-propanol which boil at about 57.3° C. at 750 mm Hg.

16. The azeotrope-like compositions of claim 15 consisting essentially of from about 90 to about 97 weight percent said 1,1-dichloro-1,2,2-trifluoropropane and from about 3 to about 10 weight percent said 2-propanol.

17. The azeotrope-like compositions of claim 15 consisting essentially of from about 91 to about 97 weight percent said 1,1-dichloro-1,2,2-trifluoropropane and from about 3 to about 9 weight percent said 2-propanol.

18. The azeotrope-like compositions of claim 15 consisting essentially of from about 92 to about 97 weight percent said 1,1-dichloro-1,2,2-trifluoropropane and from about 3 to about 8 weight percent said 2-propanol.

19. The azeotrope-like compositions of claim 15 wherein said compositions additionally contain an inhibitor in an amount effective to inhibit decomposition of said compositions, react with undesirable decomposition products of said compositions, or prevent corrosion of metal surfaces.

20. Azeotrope-like compositions consisting essentially of from about 85 to about 97 weight percent 1,1-dichloro-1,2,2-trifluoropropane and from about 3 to about 15 weight percent 2-methyl-2-propanol which boil at about 59.4° C. at 755 mm Hg.

21. The azeotrope-like compositions of claim 20 consisting essentially of from about 86 to about 96 weight percent said 1,1-dichloro-1,2,2-trifluoropropane and from about 4 to about 14 weight percent said 2-methyl-2-propanol.

22. The azeotrope-like compositions of claim 20 consisting essentially of from about 87 to about 96 weight percent said 1,1-dichloro-1,2,2-trifluoropropane and from about 4 to about 13 weight percent said 2-methyl-2-propanol.

23. The azeotrope-like compositions of claim 20 wherein said compositions additionally contain an inhibitor in an amount effective to inhibit decomposition of said compositions, react with undesirable decomposition products of said compositions, or prevent corrosion of metal surfaces.

24. A method of cleaning a solid surface which comprises treating said surface with said azeotrope-like composition as defined in claim 1.

25. A method of cleaning a solid surface which comprises treating said surface with said azeotrope-like composition as defined in claim 6.

26. A method of cleaning a solid surface which comprises treating said surface with said azeotrope-like composition as defined in claim 11.

27. A method of cleaning a solid surface which comprises treating said surface with said azeotrope-like composition as defined in claim 15.

28. A method of cleaning a solid surface which comprises treating said surface with said azeotrope-like composition as defined in claim 20.

* * * * *